United States Patent [19]

Nagai et al.

[11] 4,079,697

[45] Mar. 21, 1978

[54] ELECTRODE CONDUCTIVE ROLLER DEVELOPING DEVICE

[75] Inventors: Koji Nagai; Osamu Miyamoto; Hiromi Kameda, all of Toyokawa; Sanji Inagaki, Okazaki, all of Japan

[73] Assignee: Minolta Camera Kabushiki Kaisha, Osaka, Japan

[21] Appl. No.: 734,269

[22] Filed: Oct. 19, 1976

[30] Foreign Application Priority Data

Oct. 23, 1975 Japan ..... 50-144601[U]

[51] Int. Cl.[2] ..... B05B 5/02

[52] U.S. Cl. ..... 118/662

[58] Field of Search ..... 118/662, 661, 660, 659; 355/10; 354/318, 320

[56] References Cited

U.S. PATENT DOCUMENTS

| | | | |
|---|---|---|---|
| 3,774,574 | 11/1973 | Sato et al. | 118/651 |
| 3,808,025 | 4/1974 | Fukushima et al. | 118/662 |
| 3,817,212 | 6/1974 | Fukushima et al. | 118/651 |
| 3,822,670 | 7/1974 | Sato et al. | 118/651 |
| 3,832,975 | 9/1974 | Fukushima et al. | 118/651 |
| 3,862,619 | 1/1975 | Fukushima et al. | 118/651 |
| 3,893,417 | 7/1975 | York | 118/661 |
| 3,905,331 | 9/1975 | Kimvra et al. | 118/662 |
| 3,913,524 | 10/1975 | Fukushima et al. | 118/662 |
| 3,965,861 | 6/1976 | Fukushima et al. | 118/661 |
| 3,999,513 | 12/1976 | Qeciny et al. | 118/662 |

*Primary Examiner*—Ronald Feldbaum

*Attorney, Agent, or Firm*—Watson, Cole, Grindle & Watson

[57] ABSTRACT

At least one roller in a plurality of paired electrode rollers positioned in a liquid developer is electrically isolated from its associated electrode roller for development of the image on a copying sheet during the time in which the copying sheet is transported by the paired conductive rollers to eliminate fogging and whitening of the copied image.

9 Claims, 12 Drawing Figures

ELECTRODE CONDUCTIVE ROLLER DEVELOPING DEVICE

BACKGROUND OF THE INVENTION

This invention relates to liquid developing devices for use in electrophotographic copying machines, which devices are equipped with a plurality of paired electrode rollers, and more particularly to a developing device, in which a plurality of paired conductive rollers are positioned in a liquid developer consisting of an organic solvent (insulating liquid) and charged-toner particles which are dispersed therein, with the aforesaid paired conductive rollers being electrically connected, for example, by being grounded, to function as developing electrodes, whereby an electrostatic latent image carried on a copying sheet may be developed, during the time which the copying sheet is being transported by the aforesaid paired conductive rollers.

A developing device of the aforementioned type provides an electrode-to-electrode spacing smaller than that of a developing device equipped with electrode plates, and presents enhanced functions of the developing electrodes, so that a solid pattern may not only be reproduced in a satisfactory manner, but also there may be achieved reproduction of an electrostatic latent image at a potential of at least as low as 100V, as in the case of an electrostatic latent image on a copying sheet for use in an electrostatic latent image transfer process. The developing device of this type has been applied in a commercial electrostatic latent image transfer type copying machine.

The inventors discovered that a developing device of the aforementioned type suffers from the following shortcomings:

In the case where an electrostatic image on a copying sheet P provides distinct boundaries between a portion having charges and a portion free of charges, as shown in FIGS. 2A and 2B, in which there are shown solid patterns having charges (negative charges in the drawings) over the entire areas defined within a rectangle A1 and a triangle A2, respectively, and even though the copying sheet P itself is sufficiently dried, there develops black fogging in the form of lines, and whitened blanks. In addition, the inventors discovered that even in the case of the aforesaid electrostatic image, there develops no such a phenomenon, when the copying sheet itself is wet.

Moreover, in the case where an electrostatic image on the copying sheet is a solid pattern consisting of an inverted triangle A3 as shown in FIG. 2C, then no such a phenomenon as described above develops.

In the case where the electrostatic images provide a plurality of solid patterns of a rectangular shape, having a small width and arranged in parallel, and including a plurality of line patterns, as shown in FIG. 2D, then the aforesaid phenomenon also occurs. In other words, in those cases where the total width of the solid patterns is considerable, as measured at their rear ends in the direction that the copying sheet is being fed and also where the electrostatic images have distinct boundaries between charged portions and non-charged portions, and the copying sheet itself is sufficiently dried, then the fogging and whitened blank phenomenon occurs on the copying sheet.

The following is a more detailed description of the aforesaid fogging and whitened blank phenomenon taken in conjunction with an electrostatic image in the form of a solid rectangular pattern as shown in FIG. 2A.

FIG. 3 shows the results when the copying sheet carrying the aforesaid solid pattern was developed. In other words, a character A represents a normal toner image portion corresponding to an electrostatic image A, while characters B, F represent fogging in the form of black lines, and characters E, C, D represent whitened blanks.

The aforesaid fogging and whitened blank phenomenon is attributable to the fact that induced charges develop on the conductive developing rollers due to electrostatic images on the copying sheet. This will be described in more detail in conjunction with FIGS. 4A, 4B. FIG. 4A illustrates a whitened blank in portions E of FIG. 3 for the condition where a solid pattern on the copying sheet P is positioned between conductive rollers 3 and 4 which are both grounded. Copying sheet P consists of conductive substrate 2 and dielectric layer 1 coated thereon. Carried on dielectric layer 1 is a negatively charged solid pattern latent image.

Positive charges having a polarity opposite to that of the electrostatic image are induced onto the surface of conductive roller 3, which is positioned right above the solid pattern, while negative charges having the same polarity as that of the electrostatic image are induced onto those portions of the surface of the roller 3, which correspond to the opposite side portions E of the copying sheet P.

The reason why negative charges are induced onto such portions of the surface of the roller 3, which correspond to the opposite side portions E, is that part of the positive charges present on the conductive substrate 2 in correspondence with the electrostatic image on the dielectric layer 1 on the copying sheet P are freed due to neutralization of the electrostatic image by toner particles (positively charged) upon development, with the result that the charges thus freed are shifted to such portions of the surface of the roller 3, which correspond to the opposite side portions E on the conductive substrate 2 and remain there.

FIG. 4A shows the distribution of charges induced onto copying sheet P and conductive rollers 3, 4, in which there are produced electric fields directed from the positive charges to the negative charges as shown by the arrows, so that toner particles having positive charges are shifted in the same direction as that of the electric fields. The shifted positive charges then cling to electrostatic image A having negative charges, while the toner particles are repelled to the opposite side portions E. This results in a whitened blank phenomenon in portions E.

FIG. 4B illustrates the fogging and whitened blank phenomenon in portions B, C of FIG. 3 and shows a condition immediately after the rear end portion of the solid pattern has passed through conductive rollers 3, 4, i.e., a condition where portions B, C in FIG. 3 are positioned between the conductive rollers. When the solid pattern passes through the conductive rollers, then the polarity of charges on the surface of conductive roller 3 is abruptly reversed, as shown.

The reason why negative charges are induced onto such a portion of the surface of the roller 3, which corresponds to portion C, is considered to be a combination of normal induction resulting when, as in the case of the aforesaid portions E, part of the positive charges present on conductive substrate 2 of copying sheet P are shifted, and also because of instantaneous induction resulting from a change in the electric field due to the abrupt shifting of the charges in the solid pattern, which shifting results from the copying sheet being transported by the conductive rollers. It can be seen from the foregoing that the whitened blank phenomenon in portion C is more remarkable, as compared with that in portions E.

The reason why positive charges are induced onto the portion of the surface of the roller 3, which corresponds to portion B, is considered to be a combination of normal induction resulting from the induction of negative charges onto portion B in substrate 2, due to the shifting of part of the positive charges present on conductive substrate 2 to the portions E and C on substrate 2, and also because of instantaneous induction resulting from a change in the electric fields produced due to the abrupt shifting of induced charges onto the surface of conductive roller 3. Accordingly, there develops an electric field, as shown, in portion B, so that toner particles having positive charges cling thereto, thus resulting in fogging.

A strip type whitened blank phenomenon in portion D of FIG. 3 is considered to take place immediately after the solid pattern passes through the rollers. The reason for this is that a great amount of toner particles cling to the solid pattern, and thus there results a temporary lack of toner due to insufficient diffusion thereof.

The fogging phenomenon in portion F of FIG. 3 is shown in the form of a strip, in contrast to that of portion B, but presents low density fogging. This may be attributed to the fact that toner particles clinging to the surface of conductive roller 3 upon occurrence of the whitened blank phenomenon in portion E are off-set.

With the electrophotographic liquid developing device of such an arrangement wherein a plurality of paired electrode rollers are each electrically connected, for example by being grounded, in the case where the copying sheet is sufficiently dried, and the electrostatic image on the copying sheet is a solid pattern and the rear end portion or portions of the pattern have considerable width or total widths, there necessarily results a fogging and whitened blank phenomenon.

SUMMARY OF THE INVENTION

It is an object of the present invention to provide a liquid developing device for use in an electrophotographic reproduction, which device is equipped with a plurality of paired electrode rollers, and which device may avoid the aforesaid fogging and whitened blank phenomenon.

The feature of the developing device according to the present invention is that at least one of each paired electrode rollers on the lower side of a plurality of paired electrode rollers, each pair of which are electrically connected, is electrically insulated.

DESCRIPTION OF THE PREFERRED EMBODIMENTS

As has been described earlier, the inventors have discovered that the aforesaid fogging and whitened blank phenomenon may be eliminated by electrically insulating the lower electrode rollers. For a better understanding of the developing device according to the invention, a principle incorporated therein will be first described.

Figure 4A:
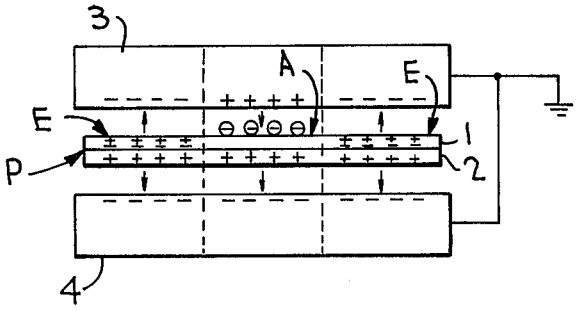
FIGS. 4A, 4B are views illustrating a process of induced charges being produced, which is associated with an undesirable pattern as shown in FIG. 3.
Figure 4B:
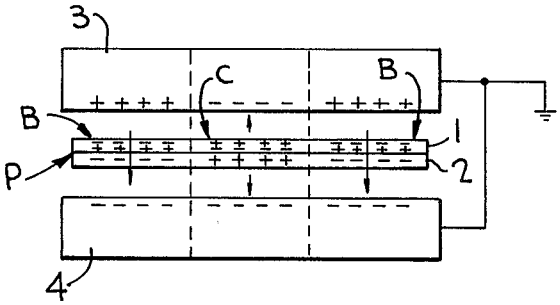
Figure 5A:
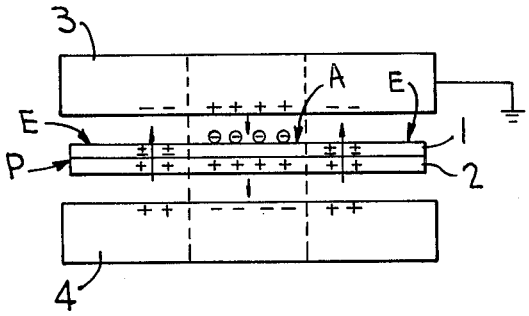
FIGS. 5A, 5B are views illustrating a process of induced charges being produced, which is associated with the solid pattern shown in FIG. 2A, with an upper electrode roller being grounded and the lower electrode roller being insulated in accordance with the invention.
Figure 5B:
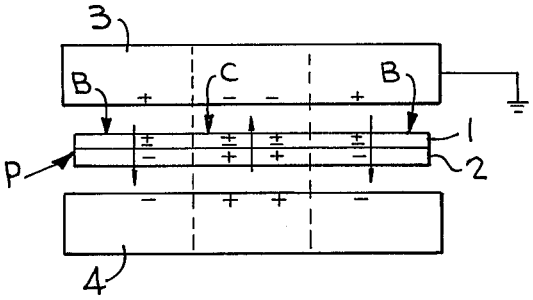

FIGS. 5A, 5B refer to the cases where a solid rectangular pattern is developed. The developing positions in FIGS. 5A, 5B correspond to FIGS. 4A, 4B, respectively.

Referring to FIG. 5A, when conductive roller 4 is insulated, negative charges are induced onto that portion of conductive roller 4 which corresponds to the solid pattern, due to the positive charges present on the surface of conductive substrate 2 of copying sheet P. As a result, positive charges are induced, as shown, onto such portions of the surface of the conductive roller 4, which correspond to opposite side portions E of the copy sheet. It is considered that due to the positive charges on the surface of conductive roller 4, the amount of positive charges shifting to the opposite side portions E of conductive substrate 2 will be reduced, as compared with the case shown in FIG. 4A, wherein rollers 4 are grounded.

As a result, the amount of negative charges to be induced onto such portions of the surface of roller 3, which correspond to the opposite side portions E of the copy sheet, are reduced, and the electric fields thereof are weakened, as compared with the case where rollers 4 are grounded. Thus, the whitened blank phenomenon in portions E may be obviated to a large extent.

Referring to FIG. 5B, as has been described earlier in conjunction with FIG. 4B, there develops in portion C immediately following the solid pattern, an instantaneous induction resulting from a change in the electric field, in addition to normal induction, while positive charges are induced onto such a portion of the surface of conductive roller 4, which corresponds to portion C, due to the same phenomenon as that in the aforesaid portions E. Therefore, the electric fields thereof are weakened, as compared with the case where rollers 4 are grounded. As a result, the whitened blank phenomenon in portions C may be obviated to a large extent. Instantaneous induction occurs in portions B following portions E resulting from the change in the electric field, in addition to normal induction, as has been described earlier in conjunction with FIG. 4B. However, the amount of positive charges shifting to portions E, C of conductive substrate 2 is less, so that the amount of negative charges to be induced onto portions B of substrate 2 is also reduced as shown. As a result, the electric fields thereof are greatly weakened as compared with the case where rollers 4 are grounded, and thus fogging in the form of lines in portions B may be obviated to a large extent.

Figure 3:
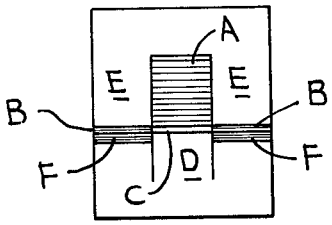
FIG. 3 is a view illustrative of an undesirable pattern produced on the surface of a copying sheet, when the solid pattern of FIG. 2A is developed in a prior art developing device having both upper and lower developing rollers grounded.

In the aforesaid manner, the whitened blank phenomenon in portions E, C as shown in FIG. 3, as well as the fogging phenomenon in portions B, may be obviated to a large extent, so that the secondary off-set fogging in portions F as well as the whitened blank phenomenon in the form of a stripe in portion D may also be obviated to a large extent.

The following is a more detailed description of the device according to the present invention by way of examples.

EXAMPLE 1

Figure 1:
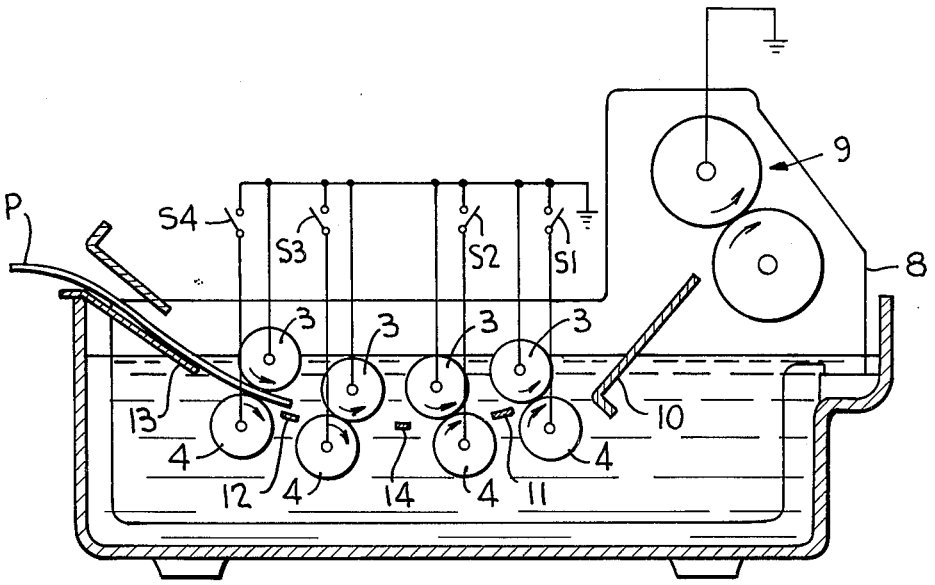
FIG. 1 is a cross-sectional view of a developing device equipped with electrode rollers according to the present invention.
Figure 6:
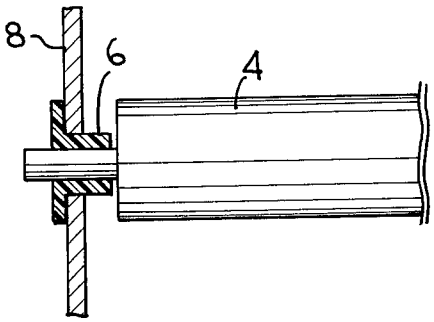
FIG. 6 is a view illustrative of the relationship of a metal roller to a bearing.
Figure 7:
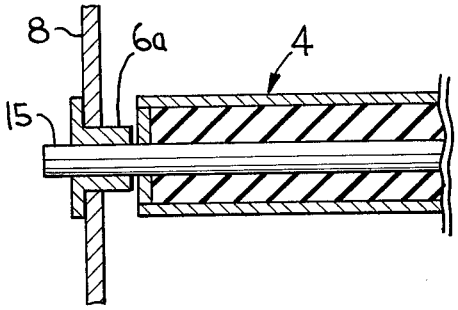
FIG. 7 is a view showing a relationship between a roller having its surface subjected to an electroconductive treatment, and a bearing.

As shown in FIG. 1, four pairs of metal rollers 3, 4 are attached to side plates 8 within the developing device. As shown in FIG. 6, the lower rollers 4 are electrically insulated by bearings 6 made of a plastic tube. This condition is represented by the OFF conditions of switches S1 to S4 in FIG. 1. Upper rollers 3 and lower rollers 4 are grounded through the medium of metal bearings 6*a*, as best shown in FIG. 7, and this condition is represented by the ON conditions of switches S1 to S4.

Guide plates 10–13 and a pair of squeeze rollers 9 are shown in FIG. 1. The pair of squeeze rollers includes an electrically grounded metal roller (upper roller) and a rubber roller (lower roller).

The reflection densities in portions B, C, D, E, F of FIG. 3 were measured for the cases 1 to 5 given below:

(1) switches S1: OFF; switches S2 to S4: ON
(2) switches S1, S2: OFF, switches S3, S4: ON
(3) switches S1 to S3: OFF, switch S4: ON
(4) switches S1 to S4: OFF
(5) switches S1 to S4: On (corresponding to the prior art developing device for comparison purpose)

The measuring conditions and results are given in Tables 1*a* and 1*b*, respectively.

EXAMPLES 2, 4 AND 5

Measurements were made in a manner similar to that of Example 1, with the measuring conditions changed as indicated in respective Tables 2*a*, 4*a* and 5*a*. The measuring conditions and results are given in Tables 2*a*, 2*b*, 4*a*, 4*b*, 5*a* and 5*b*.

EXAMPLE 3

Measurements were made in a manner similar to that shown in FIG. 1, for a device, in which two pairs of metal rollers 3, 4 are provided. The measuring conditions and results are shown respectively in Tables 3*a* and 3*b*.

As can be seen from the foregoing Examples, the reflection density of portions B of copying sheet P are greatly reduced, when the number of metal rollers 4 which are electrically insulated, is increased.

The reflection density of the portion C remained unchanged, even if one or more metal rollers 4 are insulated. In addition, when the width of the solid pattern is small, or when the surface potential of the copy sheet is low, or when the number of metal rollers to be electrically insulated is decreased (two pairs of metal rollers 4), the insulation of the metal rollers has no bearing upon the reflection density of copy sheet P.

The reflection densities in the portions E and D are progressively slightly increased, with an increase in the number of metal rollers 4.

The reflection density of portion F generally tends to be slightly reduced by insulating the metal rollers, although Examples 1, 4 and 5 fail to prove this. It is considered that an off-set phenomenon, which is developed due to induced charges, is responsible for this.

Although the foregoing description has only described the number of metal rollers and the tendencies for change of the reflection density at each respective portion of the copy sheet, the actual fogging and whitened blank phenomenon are observed by determining the differences in reflection densities by mutually comparing the reflection density at portion A and the reflection density of the copying sheet (white portion) having passed through the developing liquid with the reflection densities at portions B, C, E, D and F.

In Example 1 with all the rollers grounded, the blackened lines at portion B and the whitened blanks at portions C and E are strongly observed, respectively, while the thin blackened strip patterns are observed at portion F, although not as strongly as the blackened lines. In contrast thereto, the fogging and whitened blank phenomenon at each of the portions is somewhat corrected, but not sufficiently, if one of the rollers is electrically floated (S1 being OFF). With two rollers electrically floated, hardly no fogging and whitened blank phenomenon are observed with the exception of some fogging at portion B. Finally, no fogging and whitened blank phenomenon are observed at each of the portions when more than three rollers are electrically floated (insulated).

The aforedescribed tendency or trend was confirmed to be substantially the same for the experiment wherein the developing speed was set twice as fast, the solid pattern at portion A twice as wide, and the developing liquid density twice as dense as in Example 2.

However, for the experiment wherein the width of the solid pattern at portion A was set to be more than about half as much as in Example 4, the overall reflection density was low and was observed to be substantially the same as Example 1 with two rollers electrically floated. The fogging and whitened blank phenomenon at each of the portions are observed to be avoided compared with the cases wherein more than two rollers are electrically floated.

Accordingly, the fogging and whitened blank phenomenon at each of the portions can be avoided even with only one roller electrically floated if the width of the solid pattern at portion A is smaller.

However, no fogging and whitened blank phenomenon were observed in the experiment with all the rollers grounded (S1 – S4 being ON) and with the width of the solid pattern at portion A set to be less than 20 mm as in Example 1. Additionally, as in Example 5 wherein the maximum surface potential of the copying sheet was dropped to less than 80 volts, a substantially similar phenomenon as in Example 4 was observed.

Further, in Example 3 utilizing only two metal rollers (note that the developing liquid density is 1½ times dense as Example 1), the tendency corresponding to the case of two out of four rollers electrically floated as in Example 1 was observed when one roller was electrically floated.

Figure 2A:
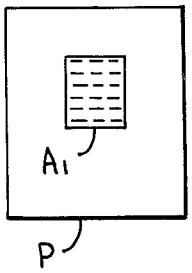
FIGS. 2A to 2D illustrate configurations of solid image patterns.
Figure 2B:
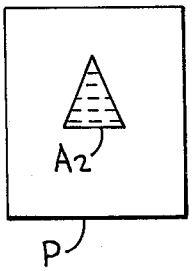
Figure 2C:
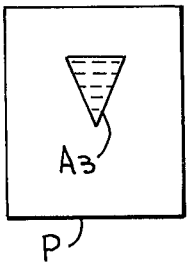
Figure 2D:
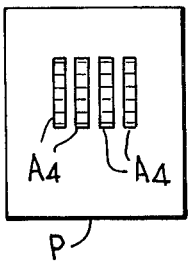

While the foregoing has been described for the solid pattern shown in FIG. 2A, the same phenomenon were observed for the case of FIG. 2B and for the case of FIG. 2D when the total widths were the same.

From the foregoing experiments, the number of lower rollers 4 to be electrically floated may be less if the widths of the solid patterns are small, or if the surface potential of the copy sheet is low, to avoid the fogging and whitened blank phenomenon. However, the number of lower rollers 4 electrically floated may be increased if the widths of the solid patterns are wide, or if the surface potential of the copying sheet is high to avoid such undesirable phenomenon.

It should be noted that although the invention thus far described has been for a developing apparatus in which the electrode rollers are electrically grounded, similar fogging and whitened blank phenomenon are also present in a developing apparatus in which the electrode rollers are connected to a bias voltage source. Accordingly, the present invention is applicable to such apparatus for avoiding the fogging and whitened blank phenomenon.

Throughout the foregoing Examples, when the surface resistance of the back surface of the copy sheet is less than $10^6\Omega$, no fogging and whitened blank phenomenon develops with the prior art device, in which the lower metal rollers 4 are grounded.

Although metal rollers are used as electrode rollers in the aforesaid tests as shown in FIG. 7, rollers 4 may be replaced by rubber rollers having iron cores 15 and their surfaces subjected to an electroconductive treatment. In case the rollers should be grounded, end faces 7 of the rubber rollers are subjected to an electroconductive treatment, so that the rollers may be grounded by metal bearings *6a* and iron cores 15. However, if the rollers should be electrically insulated, end faces 7 should not be subjected to an electroconductive treatment, and the peripheral surfaces of the rollers alone should be subjected to an electroconductive treatment. In addition, it is mandatory that surface resistances of the rubber rollers subjected to electroconductive treatment be lower than that of the back surface of copying sheet P (normally $10^5$ to $10^8\Omega$), and should preferably be less than $10^3\Omega$.

While the foregoing description has utilized a copying sheet consisting of a dielectric layer coated on an electroconductive base (which is for use in electrostatic latent image transfer type copiers), the present invention is also applicable to electrofax type copiers which utilize copying sheets consisting of a photoconductive layer coated electroconductive base.

TABLE 1a

| (Conditions of Measurement) | |
|---|---|
| Copying sheet | Kanzaki-Seishi, Paper for use in Minolta Electrographic 101 (Trade nomenclature) |
| Width of copying sheet | 210 mm |
| Surface resistance of back surface of copying sheet | $3.5 \times 10^8\Omega$ |
| Liquid developer | Phillip A. Hunt Chemical Corp. D012KK (Trade nomenclature) |
| Density liquid | OD21 - 22 |
| Size of toner particle (radius) | $0.3\mu$ |
| Electrode roller | Stainless steel |
| Developing speed | 10 cm/sec |
| Surface potential of copying sheet | 100 V (max.) |
| Reflection density on surface of copying sheet (white portion) | 0.10 |
| Reflection density of portion A developed | 1.20 |
| Width of portion A | 70 mm |
| Reflection density of copying sheet after passing through liquid developer (white portion) | 0.11 |
| Reflection densitometer (4 mm) | Konishiroku Shashin Kogyo Sakura PDA - 30 |
| Micro-reflection densitometer (0.1 mm) | Nippon Denshoku Kogyo MMP - 2D |

TABLE 1b

| (Results of measurements) Reflection density | Portion B | Portion C | Portion E | Portion D | Portion F |
|---|---|---|---|---|---|
| Switch S1 OFF Switch S2 - S4 ON | 0.30 | 0.11 | 0.11 | 0.11 -0.14 | 0.12 - 0.15 |
| Switch S1,S2 OFF Switch S3 S4 ON | 0.23 | 0.11 | 0.12 | 0.12 - 0.14 | 0.12 - 0.15 |
| Switch S1 - S3 OFF Switch S4 - ON | 0.16 | 0.11 | 0.12 - 0.13 | 0.12 - 0.14 | 0.12 - 0.14 |
| Switch S1 - S4 OFF | 0.14 | 0.11 | 0.12 - 0.14 | 0.13 - 0.14 | 0.13 - 0.14 |
| Switch S1 - S4 ON (Comparative Example) | 0.40 | 0.105 - 0.11 | 0.11 | 0.11 - 0.13 | 0.13 - 0.16 |

TABLE 2a

| (Conditions of Measurement) | |
|---|---|
| Liquid Developer | Phillip A Hunt Chemical Corp. D012KK (Trade nomenclature) |
| Density of liquid | OD40 - 42 |
| Liquid developer for supply | DO03K1 |
| Developing speed | 20 cm/sec. |
| Reflection density of portion developed | 1.15 |
| Width of portion A | 150 mm |

Particulars other than those given above are the same as those shown in Table 1.

TABLE 2b

| (Results of measurements) Reflection density | Portion B | Portion C | Portion E | Portion D | Portion F |
|---|---|---|---|---|---|
| Switch S1 OFF Switch S2 - S4 ON | 0.4 | 0.11 | 0.11 | 0.11 - 0.14 | 0.2 - 0.3 |
| Switch S1,S2 OFF Switch S3,S4 ON | 0.3 | 0.11 | 0.12 | 0.11 - 0.14 | 0.2 |
| Switch S1 - S3 OFF Switch S4 ON | 0.16 - 0.18 | 0.11 | 0.12 - 0.13 | 0.12 - 0.13 | 0.13 - 0.15 |
| Switch S1 - S4 OFF | 0.15 | 0.11 | 0.12 - 0.14 | 0.13 - 0.15 | 0.13 - 0.15 |
| Switch S1 - S4 ON (Comparative Example) | 0.5 | 0.105 - 0.11 | 0.11 | 0.11 | 0.2 - 0.4 |

TABLE 3a

| (Conditions of Measurement) | |
|---|---|
| Liquid developer | Phillip A Hunt Chemical Corp. D012KK (Trade nomenclature) |
| Density of liquid | OD36 - 38 |
| Liquid developer for supply | DOO3K1 (Trade nomenclature) |
| Reflection density of portion A developed | 1.05 |

Particulars other than those given above are the same as those shown in Table 1.

TABLE 3b

| (Results of Measurments) Reflection density | Portion B | Portion C | Portion E | Portion D | Portion F |
|---|---|---|---|---|---|
| Switch S1 OFF S2 ON | 0.23 | 0.11 | 0.12 - 0.13 | 0.11 - 0.14 | 0.20 |
| Switch S1 S2 OFF | 0.14 - 0.12 | 0.11 | 0.12 - 0.14 | 0.12 - 0.14 | 0.12 - 0.14 |
| Switch S1 S2 ON (Comparative | 0.40 | 0.11 | 0.11 | 0.11 | 0.30 |

TABLE 3b-continued

| | (Results of Measurments) Reflection density | | | | |
|---|---|---|---|---|---|
| | Portion B | Portion C | Portion E | Portion D | Portion F |
| Example) | | | | | |

TABLE 4a

| (Conditions of Measurement) | |
|---|---|
| Width of portion (A) | 40mm |

Particulars other than those given above are the same as those shown in Table 1.

TABLE 4b

| | (Results of measurements) Reflection density | | | | |
|---|---|---|---|---|---|
| | Portion B | Portion C | Portion E | Portion D | Portion F |
| Switch S1 OFF | | | 0.12 | 0.11 | 0.12 |
| Switch S2 - S4 ON | 0.20 | 0.11 | | - 0.14 | - 0.14 |
| Switch S1, S2 OFF | | | 0.12 | 0.12 | 0.12 |
| Switch S3, S4 ON | 0.17 | 0.11 | - 0.13 | - 0.14 | - 0.14 |
| Switch S1 - S3 OFF | | | 0.12 | 0.12 | 0.12 |
| Switch S4 ON | 0.15 | 0.11 | - 0.14 | - 0.14 | - 0.14 |
| Switch S1 - S4 OFF | 0.13 | 0.11 | 0.12 | 0.12 | 0.12 |
| | | | - 0.14 | - 0.14 | - 0.14 |
| Switch S1 - S4 ON | | | 0.11 | 0.11 | 0.12 |
| (Comparative Example) | 0.26 | 0.11 | | - 0.14 | - 0.15 |

TABLE 5a

| (Conditions of Measurement) | |
|---|---|
| Surface potential of copying sheet | 80 V (max) |

Particulars other than those given above are the same as those shown in Table 1.

TABLE 5b

| | (Results of measurements) Reflection density | | | | |
|---|---|---|---|---|---|
| | Portion B | Portion C | Portion E | Portion D | Portion F |
| Switch S1 OFF | | | 0.12 | 0.11 | 0.12 |
| Switch S2 - S4 ON | 0.25 | 0.11 | | - 0.14 | - 0.15 |
| Switch S1, S2 OFF | | | 0.12 | 0.12 | 0.12 |
| Switch S3, S4 ON | 0.19 | 0.11 | - 0.13 | - 0.14 | - 0.14 |
| Switch S1 - S3 OFF | | | 0.12 | 0.12 | 0.12 |
| Switch S4 ON | 0.16 | 0.11 | - 0.14 | - 0.14 | - 0.14 |
| | | | 0.12 | 0.12 | 0.12 |
| Switch S1 - S4 OFF | 0.13 | 0.12 | - 0.14 | - 0.14 | - 0.14 |
| | | | 0.11 | 0.11 | 0.12 |
| Switch S1 - S4 ON (Comperative Example) | 0.30 | 0.11 | | - 0.14 | - 0.16 |

What is claimed is:

1. In an electrophotographic wet type developing apparatus including plural pairs of conductive rollers for developing and transporting copying paper bearing an electrostatic latent image consisting of a solid pattern or a plurality of separated solid patterns, the improvement comprising electrically insulating at least one of said conductive rollers facing the rear face of the copying paper in said plural pairs of conductive rollers, and the remaining electrode conductive rollers being grounded.

2. The improvement as in claim 1 wherein said one conductive roller is electrically insulated at the discharge side of the apparatus.

3. The improvement as in claim 1 wherein the total widths of the trailing edge of the electrostatic latent image of the solid pattern are more than 40 mm and the surface potential of the electrostatic latent image of the solid pattern is more than 80 volts.

4. The improvement as in claim 1 wherein there are four pairs of said conductive rollers and said conductive roller facing the rear face of the copying paper in at least two of said four pairs of conductive rollers are electrically insulated for developing the image in which the total widths of the trailing edge of the electrostatic latent image of the solid pattern are more than 70 mm and the surface potential of the electrostatic latent image of the solid pattern is more than 100 volts.

5. The improvement as in claim 1 wherein there are four pairs of said conductive rollers and said conductive rollers facing the rear face of the copying paper in at least three of said four pairs of conductive rollers is electrically insulated for developing the image in which the total widths of the trailing edge of the electrostatic latent image of the solid pattern are more than 150 mm and the surface potential of the electrostatic latent image of the solid pattern is more than 100 volts.

6. The improvement as in claim 1 wherein said conductive rollers include a metallic shaft coated with conductively treated rubber on its peripheral and end surfaces and the electrically insulated roller is insulated by utilizing a roller having no conductive treatment on the end surface thereof.

7. The improvement as in claim 1 wherein said apparatus includes grounded side plates and wherein said at least one electrically insulated electrode conductive roller is insulated from said grounded side plates by bearings made of an electrically insulating material, and said remaining conductive rollers are grounded through metal bearings to said grounded side plates.

8. The improvement as in claim 7 wherein each of said plural pairs of electrode conductive rollers consists of metal rollers.

9. The improvement as in claim 7 wherein each of said plural pairs of electrode conductive rollers includes a metallic shaft coated with conductively treated rubber on its peripheral and end surfaces.

* * * * *